United States Patent [19]

Satkin

[11] 3,934,329

[45] Jan. 27, 1976

[54] METHOD OF AND APPARATUS FOR ATTACHING FASTENERS FOR CLOTH AND THE LIKE

[75] Inventor: Jeff Satkin, New York, N.Y.

[73] Assignee: Lawrence Peska Associates, Inc., New York, N.Y. ; a part interest

[22] Filed: Oct. 10, 1974

[21] Appl. No.: 513,881

[52] U.S. Cl. ..... 29/453; 227/18; 227/36; 227/37; 227/77; 227/120; 227/136; 227/138

[51] Int. Cl.[2] ..... B23P 11/02

[58] Field of Search ..... 29/453, 432, 432.1, 432.2, 29/200 B, 200 R, 211 R, 211 D, 526; 227/16, 77, 120, 136, 138, 18, 37, 15; 85/81, 36; 24/73 B; 221/70, 71

[56] References Cited

UNITED STATES PATENTS

| | | | |
|---|---|---|---|
| 2,157,216 | 5/1939 | Pollard | 29/432 |
| 2,538,396 | 1/1951 | Sutin | 29/453 |
| 2,636,235 | 4/1953 | Nygard | 29/453 |
| 2,946,059 | 7/1960 | Wandel | 227/136 |
| 3,208,657 | 9/1965 | Cohn | 227/18 |
| 3,469,758 | 9/1969 | Volkman | 227/120 |
| 3,554,426 | 1/1971 | Schmidt | 227/18 |
| 3,632,033 | 1/1972 | Schmidt | 227/18 X |
| 3,661,251 | 5/1972 | Waeltz | 227/136 X |
| 3,708,062 | 1/1973 | Feldheim et al. | 227/18 X |
| 3,786,980 | 1/1974 | Passer | 227/120 |
| 3,789,496 | 2/1974 | Barabas | 29/453 |
| 3,854,190 | 12/1974 | Stark | 29/432.1 |

*Primary Examiner*—Milton S. Mehr
*Assistant Examiner*—Joseph A. Walkowski
*Attorney, Agent, or Firm*—Jack D. Slobod

[57] ABSTRACT

A fastener for cloth and similar materials is secured thereto by means of apparatus which includes an elongated member which is tempered in the form of a coil. Absent restraint the coil will move in a direction which is tangential to the envelope of the coil and carry therewith portions of the fastener and in cooperation with a base and a punch the members of the fastener are assembled.

2 Claims, 7 Drawing Figures

METHOD OF AND APPARATUS FOR ATTACHING FASTENERS FOR CLOTH AND THE LIKE

BACKGROUND OF THE INVENTION

The invention pertains to fasteners and particularly fasteners suitable for woven cloth as well as non-woven fabrics which in recent years have become more common. The prior art includes a variety of fasteners which do not require sewing to the fabric and also a variety of mechanisms for fixing such fasteners to the fabric. More specifically Neeley, U.S. Pat. No. 3,520,462 issued July 14, 1970 shows a fastener which appropriates the use of a staple and a button having two corresponding apertures for cooperation with the legs of the staple. The patent also shows a stapler mechanism for fixing the portions of the fastener together. Similarly Elliott, et al. U.S. Pat. No. 1,136,518 issued Apr. 20, 1915 shows a fastener having what might best be considered a staple which is clinched through the cloth. The apparatus shown in these patents in general involve the use of elements for the fastener which are manually positioned. Such manual positioning is not desirable because of the time involved particularly with the increases in labor costs which have been occurring since the development of the apparatus shown in the patents referred to.

Accordingly, it is a primary object of the invention to provide apparatus in a method for feeding elements of a fastener in an automatic manner.

Still another object of the invention is to provide apparatus in a method for feeding portions of a fastener in a manner which is simple and inexpensive.

SUMMARY OF THE INVENTION

It has now been found that these and other objects of the invention may be satisfied by a method of feeding and affixing fasteners for cloth and the like which includes providing a first member having an aperture therein, providing a elongated second member having a head and a bulbous other end dimensioned and configured for engagement with said aperture. In accordance with the method a cloth is positioned intermediate the first and second members followed by the feeding of one second member proximate to the first member by means of an elongated generally planar feed member which is tempered to form a coil. The feed member maintains a force and a direction parallel to the direction of elongation of said member. Also in accordance with the invention the next step is to provide a stop to position the aperture of the first member and the second member in coaxial relationship.

In various embodiments of the invention three discreet members may be provided instead of two. The material chosen for the fastener may be either metal or plastic.

The apparatus also in accordance with the invention for feeding an element of a fastener having at least two engaging portions comprising an elongated ribbon of metal which is tempered to form a coil when constrained, means are provided for carrying the first portion of a fastener on the ribbon and means are also provided for registry of said first portion of said fastener with the second portion of the fastener together with punch means for positioning said first and second portions of said fasteners in engaged relation.

BRIEF DESCRIPTION OF THE DRAWING

The invention will be better understood by reference to the accompanying drawing in which.

DESCRIPTION OF THE PREFERRED EMBODIMENT

Figure 1:
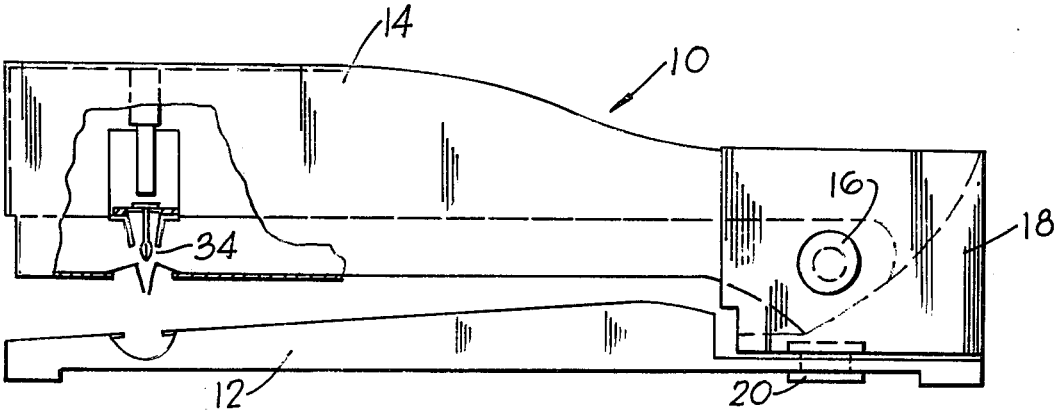
FIG. 1 is a side elevational view of the apparatus in accordance with the invention.
Figure 6:
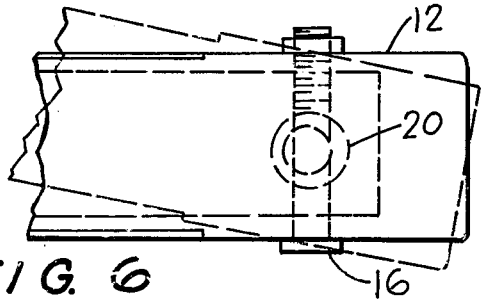
FIG. 6 is a plan view of the apparatus shown in FIG. 1, illustrating more particularly the pivoting action about a vertical axis.

Referring now to FIGS. 1 through 6 there is shown the apparatus in accordance with the invention, which includes a punch 10 which includes a base 12 and pivotally carried member 14 mounted on a first pivot 16 which is coupled to a member 18 in turn carried by pivot 20 for pivoting about a vertical axis in the manner shown in FIG. 6.

A typical fastener in accordance with the invention comprises a first member 30 having an aperture 32 disposed therein for cooperation with a second member 34 which includes a head 36 and a bulbous other end 38. In operation the bulbous end 38 may be merely forced through the aperture 32 so that it cannot readily return or alternatively particularly in the embodiment made of metal may be deformed to the generally planar shape 40 shown in FIG. 5.

Figure 2:
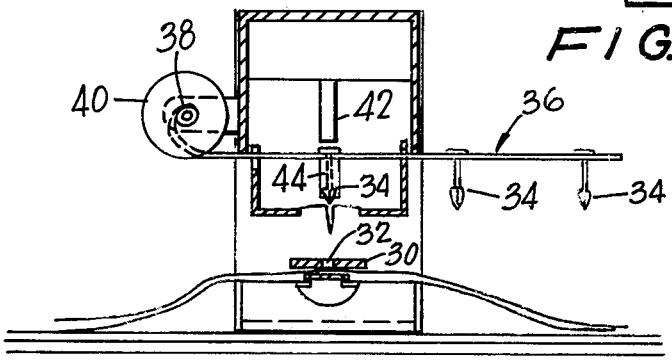
FIG. 2 is a front elevational view of the apparatus shown in FIG. 2 including the means for feeding one portion of the fastener.
Figure 3:
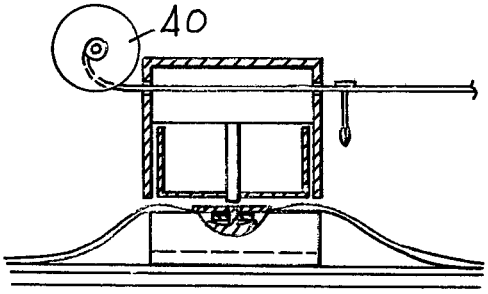
FIG. 3 is a view similar to that shown in FIG. 2 with the punch in the depressed position.
Figure 4:
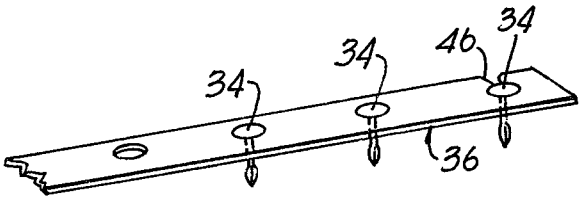
FIG. 4 is a perspective view of the ribbon provided for feeding one portion of the fastener.
Figure 7:
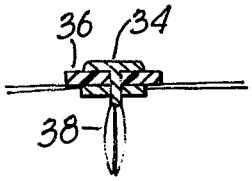
FIG. 7 is a sectional view of still another fastener.
Figure 5:
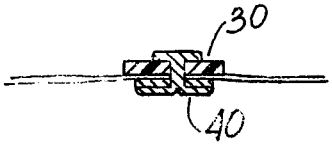
FIG. 5 is a sectional view of one fastener.

The apparatus for feeding the elongated member 34 automatically is best shown in FIGS. 2, 3 and 4 and includes a ribbon 36 of what would normally be tempered steel. The ribbon 36 will naturally form a coil 38 which is accommodated by means of a drum 40. The spring action of the ribbon 36 causing to coil on the drum 40 will urge successive elongated members 34 into position beneath a punch 42 which is selectively moved about pivot 16. Registry of member 34 with punch 42 is provided by means of a stop 44 which is selectively moved out of the way when particularly elongated member 34 has been urged into cooperation with the aperture 32 of a member 30. In some forms of the invention an opening 46 will be provided extending transversely to one side of the ribbon 36 to allow the ribbon to be removed upon mating of the members 34 and 30.

I claim:

1. A method of feeding and affixing fasteners for cloth and the like which comprises: providing a plurality of first fastener members each having an aperture extending therein; providing a plurality of elongated second fastener members inserted in holes spaced apart along an elongated coiled tempered feed strip, said second elongated members each having an end dimensioned and configured for engagement with said aperture, positioning the associated cloth intermediate a free end of said strip and one of said first fastener members, supporting the coiled strip in a manner for the coil of the strip to urge the strip end to advance along the cloth, stopping the advancement of said strip end with one of said second members on said strip in coaxial relationship with the aperture, and forcing axially said second member into said aperture of said first member.

2. Apparatus for feeding and affixing a series of elongated fasteners to a work piece comprising: an elongated ribbon tempered to form a coil; spaced apart aperture means along said ribbon for carrying said elongated fasteners; a vertically reciprocatable punch means; means for supporting said coiled ribbon adjacent said punch means; means for guiding a free end of said ribbon for advancement under said punch means, said coil having sufficient resilience for advancing the free end of the ribbon through said guide means; means for supporting the work piece below said ribbon; and stop means positioned proximate to said punch means and coacting with fasteners on said ribbon for stopping the advancement of the free end of the ribbon with one of said fasteners positioned in registry with said punch means.

* * * * *